US005930564A

United States Patent [19]

Ookaji

[11] Patent Number: 5,930,564

[45] Date of Patent: Jul. 27, 1999

[54] IMAGE FORMING APPARATUS AND A METHOD OF FORMING AN IMAGE

[75] Inventor: Hiroyuki Ookaji, Yokohama, Japan

[73] Assignee: Ricoh Company, Ltd., Tokyo, Japan

[21] Appl. No.: 09/065,463

[22] Filed: Apr. 24, 1998

[30] Foreign Application Priority Data

May 1, 1997 [JP] Japan ..... 9-113920

[51] Int. Cl.[6] ..... G03G 15/00; G03G 21/16

[52] U.S. Cl. ..... 399/125; 399/313

[58] Field of Search ..... 399/121, 110, 399/125, 114, 313, 122

[56] References Cited

U.S. PATENT DOCUMENTS 4,984,024 1/1991 Ohkaji et al. .

5,041,872 8/1991 Nukaya et al. ..... 399/110 X 5,440,373 8/1995 Deki et al. ..... 399/125 X 5,574,550 11/1996 Okazaki et al. ..... 399/313

5,669,054 9/1997 Uchida ..... 399/121 X

*Primary Examiner*—S. Lee

*Attorney, Agent, or Firm*—Oblon, Spivak, McClelland, Maier & Neustadt, P.C.

[57] ABSTRACT

An image forming apparatus which allows easy recognizing of jammed paper and easy removing of the jammed paper and further easy recognizing of an interior of a machine main body. An image is formed on a photosensitive drum, and a transfer unit is disposed to contact an outer circumferential surface of the photosensitive drum. The transfer unit includes a transfer belt for transporting transfer paper electrostatically absorbed thereon and guiding the transfer paper to a fixing unit. An outer cover supports the transfer unit so as to move the transfer unit in a direction of separating the transfer unit from the photosensitive drum when the outer cover is opened and for guiding transfer paper discharged from a fixing unit.

29 Claims, 3 Drawing Sheets

IMAGE FORMING APPARATUS AND A METHOD OF FORMING AN IMAGE

BACKGROUND OF THE INVENTION

1. Field of the Invention

The present invention relates to an image forming apparatus of an electrophotographic type employed in a copying machine and method, etc., and in particular to an image forming apparatus including a transferring section thereof.

2. Description of the Background Art

An image forming apparatus of an electrophotographic type is known in which a toner image is formed on an image carrier, such as a photosensitive drum, and is transferred onto a transfer belt, and in which the toner image transferred onto the transfer belt is further transferred onto a transfer paper, see for instance as described in the published specifications of Japanese Laid-Open Patent Publication Nos. 64-40848/1989 and 6-348148/1994. An image forming section included in background transfer units of such image forming apparatuses is explained referring to FIG. 3.

FIG. 3 is an outline structural diagram illustrating a background image forming section in an image forming apparatus utilizing laser light. In FIG. 3, developing apparatuses 52 and 53 respectively accommodate therein developers of different colors. A laser light generating section 55 reads out image data from an original document by use of a scanner (not shown in FIG. 3) and exposes a photosensitive drum 51 with optical image data through a mirror 54. A cleaner 56 cleans a surface of the photosensitive drum 51, and a transfer belt 57 is disposed such that a part of the transfer belt 57 is brought into contact with the photosensitive drum 51.

An eraser 58 radiates an erasing light onto the photosensitive drum 51 so that toner is not put on a portion not to be formed with an image thereon. The eraser 58 is disposed between the radiating portion of the photosensitive drum 51, onto which the light from the laser light generating section 55 impinges, and the developing apparatus 52. Further, a peeling-off claw 59 peels off transfer paper (not shown) attached to the photosensitive drum 51 and is positioned between the cleaner 56 and the transfer belt 57. Moreover, a charge removing charger 61 and a charging charger 62 are disposed between the cleaner 56 and the developing apparatus 52 in a rotating direction when the photosensitive drum 51 rotates in the clockwise direction as shown by the arrow in FIG. 3. A further charging charger 63 and LED array 64 are disposed between the developing apparatuses 52 and 53 in the rotating direction of the photosensitive drum 51.

The transfer belt 57 is constructed with an elastic substance and is suspended between a driving roller 65 and a driven roller 66 with a suitable tension. A transfer roller 67 for applying a transfer bias voltage and a cleaning blade 68 for scraping off toner from a surface of the transfer belt 57 are arranged around the transfer belt 57. A support frame 69 is disposed on a lower surface of the transfer belt 57 so as to surround the transfer belt 57. The support frame 69 is mounted rotatably on an image forming apparatus main body (not shown) so as to descend on the driven roller 66 side by an action of rotating around the supporting shaft 71 at the side of the driving roller 65 as a fulcrum.

The driven roller 66 side of the transfer belt 57 is elastically pressed against the photosensitive drum 51 by action of a pressing spring 72. The reference numeral 73 represents an attaching/detaching lever for releasing the pressing force of the pressing spring 72 at a time of a waiting state. If the pressing force of the pressing spring 71 is released by handling the attaching/detaching lever 73, the transfer belt 57 is rotated by a force of its weight thereof around the driving roller 65 as a fulcrum, and thereby the transfer belt 57 is separated from the photosensitive drum 51. The reference numeral 74 represents an opening lever for separating the transfer belt 57 from the photosensitive drum 51, and 75 represents a pair of registration rollers for feeding transfer paper from a paper feeding tray (not shown) to the transfer section.

As mentioned heretofore, the background image forming apparatus of the transfer belt type has adopted a mechanical structure in which transfer belt 57 is pushed from a lower position and brought into contact with the photosensitive drum 51 and the transfer paper passes between the transfer belt 57 and photosensitive drum 51. For this reason, in a case that a transfer paper jamming occurs during a time period when an image forming operation is performed, as operations in removing the jammed paper, a front cover (not shown) of the machine main body is opened at first, and then the transfer belt unit is separated from the photosensitive drum 51 by use of the opening lever 74. Then, by an operator looking into the interior of the machine in order to confirm the existence of jammed paper, the jammed paper is removed if it exists in the machine. In this way, it is necessary to perform these three working processes as mentioned above to remove a jammed paper. After removing the jammed paper, the above working processes are performed in the reverse order, for returning the machine to its initial state. These are the working processes of the background machine.

However, according to the aforementioned working processes, it is often difficult for an operator to understand the required method of handling the opening lever 74, and it is also difficult to recognize the position of the jammed paper as the interior of the machine is dark. Furthermore, if it is necessary for the operator to put his/her hand(s) in the interior of the machine in order to remove the jammed paper, the operator's hand is apt to be injured or made dirty on some occasions. Moreover, the operator may often forget to return the opening lever 74 to its closed position after the jammed paper is removed. On this occasion, the front cover has to be opened again in order to return the opening lever 74 to its closed position. In addition, if the rotative fulcrum of the transfer belt 57 for attaching to and detaching from the photosensitive drum 51 is simply set to the machine main body, a phenomenon may occur several times that the transfer paper is electrostatically absorbed onto the transfer belt 57 and is transported thereby after being put between the rollers of a fixing section. In such a situation, if the driving roller 65 of the transfer belt 57 and the rollers of the fixing section are not disposed in parallel with each other, such a state results in an occurrence of folding and/or wrinkling of the transfer paper or an occurrence of shifting of the transfer belt 57.

Furthermore, although the aforementioned transferring apparatus disclosed in the published specification of Japanese Laid-open Patent Publication No. 6-348148/1994 includes a pressurizing section for elastically pressurizing the transfer belt 57 onto the photosensitive drum 51, the force of gravity is utilized to separate the transfer belt 57 from the photosensitive drum 51. For this reason, depending on the direction of bringing the transfer belt 57 into contact with the photosensitive drum 51, even though the pressurizing section for pressurizing the transfer belt 57 is released, no force is exerted on the transfer belt 57 in the direction of being separated from the photosensitive drum 51, and thereby a troublesome matter due to incorrect releasing occurs on some occasions.

SUMMARY OF THE INVENTION

The present invention has been made in consideration of the above-mentioned problems in order to improve such and other various subject matter.

It is an object of the present invention to solve and improve the above-mentioned subject matter or drawbacks in the background art.

It is another object of the present invention to provide a novel image forming apparatus including a transferring apparatus in which recognition of jammed paper by sight of an operator and the taking-out of the jammed paper can be easily executed regardless of the existence of the transferring apparatus, and the operator can easily see into the interior of the apparatus.

It is still another object of the present invention to provide a novel image forming apparatus capable of reducing folding and wrinkling of a transfer paper and preventing shifting of a transfer belt when removing a jammed paper.

It is still another object of the present invention to provide a novel image forming apparatus capable of easily setting an arrangement of parts constructing an internal structure of the novel image forming apparatus.

It is still another object of the present invention to provide a novel image forming apparatus capable of improving a margin of apparatus designing.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENT OF THE INVENTION

Figure 1:
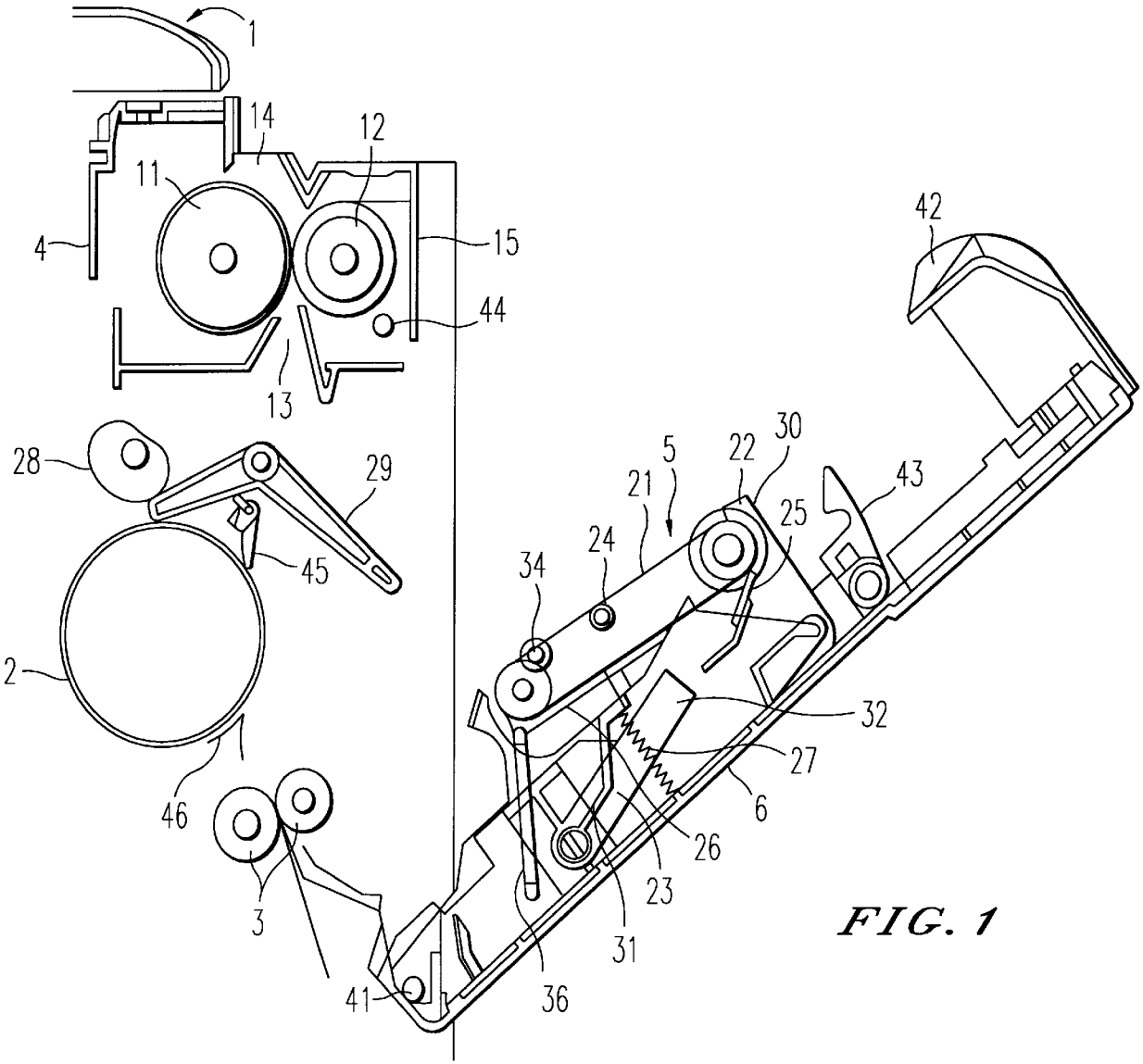
FIG. 1 is an outline structural view showing an image forming apparatus relating to an embodiment of the present invention in a state of opening an outer cover thereof.

An embodiment of the present invention is now explained hereinafter, referring to FIG. 1 and FIG. 2, in which like reference numerals designate identical or corresponding parts.

FIG. 1 is an outline structural view showing a state of opening an outer cover in an image forming apparatus of an embodiment of the present invention. FIG. 2 is an outline structural view showing a state of closing the outer cover of the same image forming apparatus. In FIGS. 1 and 2, since the sections necessary for forming the image, such as the developing unit, cleaner, charger, etc., and the paper feeding section for sending out transfer paper to the transfer section are well known, these elements are omitted from the Figures and are not explained in detail below.

In an interior of a main body of the image forming apparatus 1, a photosensitive drum 2 is arranged and is supported such that an axis line thereof is almost horizontal, a pair of registration rollers 3 are disposed below the photosensitive drum 2 and send out transfer paper from a paper feeding section (not shown) in a direction toward the photosensitive drum 2, and a fixing unit 4 is disposed above the photosensitive drum 2 and fixes a toner image transferred from the photosensitive body 2 onto the transfer paper. A transfer unit 5, a part of which is attached to and detached from the photosensitive drum 2, is mounted on an outer cover 6 for covering a side surface of the image forming apparatus main body 1 and can be opened and closed.

The fixing unit 4 is composed of a fixing roller 11, a pressurizing roller 12 disposed to come into contact with an outer circumferential surface of the fixing roller 11, and a housing for accommodating the fixing roller 11 and the pressurizing roller 12. A paper inserting inlet 13 for guiding a transfer paper from the side of the photosensitive drum 2 is opened at a lower side of a nip portion formed between the fixing roller 11 and the pressurizing roller 12, and a paper discharging outlet 14 is provided at an upper side of the nip portion.

The transfer unit 5 is constructed so as to include a transfer belt 21 made of an elastic material such as rubber, a driving roller 22 and a driven roller 23 for supporting the transfer belt 21 with suitable tension, a transfer roller 24 for applying a transfer bias voltage to the transfer belt 21, and a cleaning blade 25 for scraping off toner form the surface of the transfer belt 21.

The respective structural members excluding the cleaning blade 25 are supported on a rockingly moving frame 26, and the frame 26 is rockingly supported on a supporting frame 30 of the transfer unit 5 fixed on the outer cover 6. The cleaning blade 25 is supported by the supporting frame 30. The rockingly moving frame 26 is fixed at a side of the driving roller 22, and a supporting shaft thereof (not shown) and a shaft of driving roller 22 are supported together by the supporting frame 30. The driven roller 23 is rockingly supported between the photosensitive drum 2 and the outer cover 6. In such a structure, the transfer belt 21 can be attached to and detached from the photosensitive drum 2 at a side of the driven roller 23.

One end of a pressing spring 27 constructed with, e.g., a coil spring, etc., is fixed on an inner wall surface of the supporting frame 30. Another end of the pressing spring 27 is brought into direct contact with a free end of a rockingly moving arm 31. The pressing spring 27 always biases the rockingly moving arm 31 in a counterclockwise direction as shown in FIG. 1 and FIG. 2. Consequently, the transfer belt 21 turns out to be elastically pressed against the photosensitive drum 2 by the rockingly moving arm 31. Releasing the pressing of the transfer belt 21 is performed by a cam 28 and first and second levers 29 and 32. That is, the cam 28 is mounted on a tip end of a clutch (not shown) in order to separate the transfer belt 21 from the photosensitive drum 2 at a time of a waiting state, for the purpose of preventing an outer circumferential surface of the photosensitive drum 2 from being made dirty with the plasticizer, etc., of the toner.

One end of the first lever 29 is brought into direct contact with a cam surface of the cam 28. Another end of the first lever 29 is supported on the image forming apparatus main body 1 so as to rotate in a direction opposing the pressing force of the pressing spring 27 by operation of rotation of the cam 28. One end of the second lever 32 is rotatively supported on the supporting frame 30. Another end of the second lever 32 is disposed so as to be brought into contact with the first lever 29 such that the second lever 32 is attached thereto and detached therefrom by action of the rocking movement of the first lever 29. One end of the rockingly moving arm 31 is supported on the rotatively supporting section of the second lever 32. The relative positional relationship between the second lever 32 and the rockingly moving arm 31 is fixed. The free end side of the arm 31 is elastically (resiliently) pressed in the direction of the photosensitive drum 2 by the pressing spring 27.

One end of a pulling spring 36 is mounted on the supporting frame 30, while another end of the pulling spring 36 is mounted on the rockingly moving frame 26 at the side of the driven roller 23. A force exerted by the elasticity of the pulling spring 36 is set to a value smaller than the pressing force of the pressing spring 27. When the second lever 32 is not pressed by the first lever 29, the second lever 32 is elastically energized clockwise around the fulcrum at the side of the driving roller 22 as shown in FIG. 1, and thereby the transfer belt 21 is put in a state of rising up.

A lower end side of the outer cover 6 is mounted on the lower portion of the image forming apparatus main body 1 so as to rotate around the rotative shaft 41. An upper end side of the outer cover 6 is located at an upper position of a paper discharging outlet 14 when the outer cover 6 is closed, and the upper end side thereof constructs a paper guide 42. A stop lever 43 is provided on a rear surface of the outer cover 6. The stop lever 43 is engaged with a stop pin 44 provided in the fixing unit 15 in a standing state, and thereby the outer cover 6 is kept in a state of closing at the side portion of the image forming apparatus main body 1.

Figure 2:
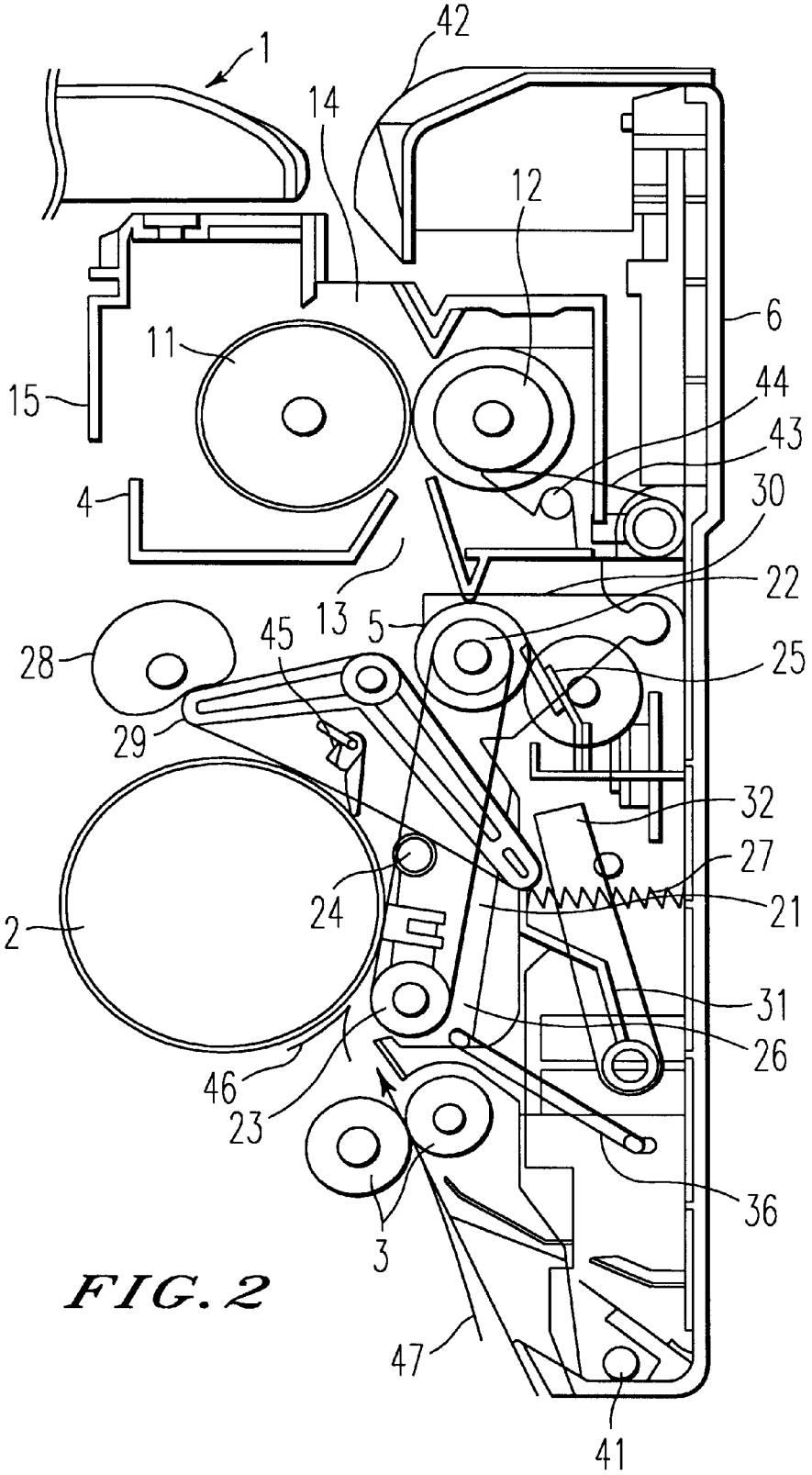
FIG. 2 is an outline structural view showing an image forming apparatus of FIG. 1 in a state of closing the outer cover thereof.
Figure 3:
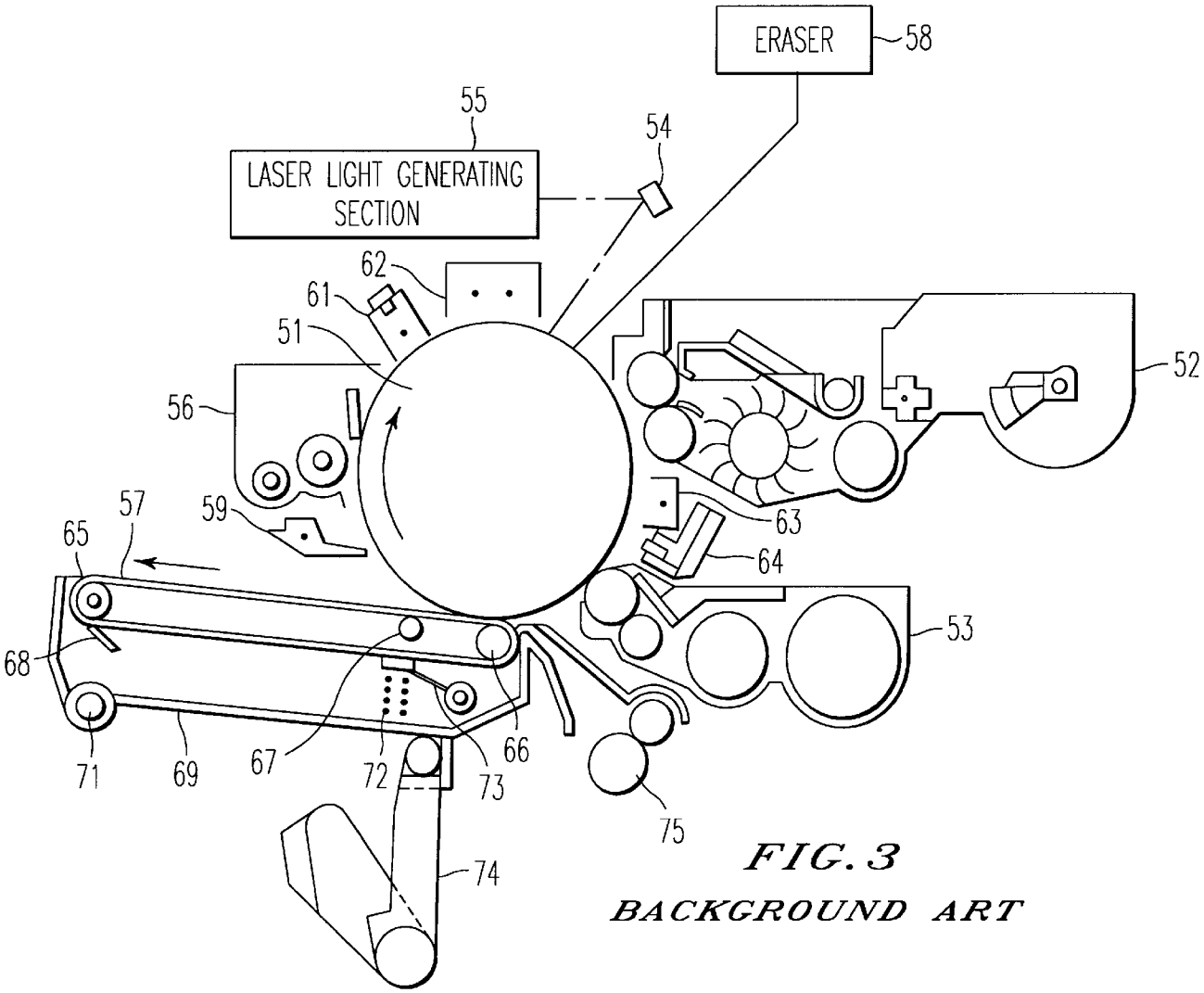
FIG. 3 BACKGROUND ART
FIG. 3 is an outline structural view of a transferring apparatus in a background image forming apparatus.

In FIGS. 1 and 2, the reference numeral 45 represents a peeling-off claw for peeling off transfer paper (not shown) attached to a surface of the photosensitive drum 2, and the reference numeral 46 represents a paper feeding guide for sending transfer paper between the photosensitive drum 2 and the transfer belt 21.

As shown in FIG. 2, since the apparatus is constructed as mentioned heretofore, when the outer cover 6 is closed a transfer paper sent from a paper feeding section (not shown) passes through the route as shown by an arrow 47 and is fed between the photosensitive drum 2 and the transfer belt 21 through the registration roller pair 3. At a time of waiting for the transferring operation, the cam 28 rotates clockwise starting at the position shown in FIG. 2 and the cam surface of the cam 28 pushes down one end of the first lever 29. Thereby, the other end of the first lever 29 pushes the free end side of the rockingly moving arm 31 through the second lever 32 against the pressing force of the pressing spring 27 in the direction of the outer cover 6. As a result, the elastic force of the pressing spring 27 applied to the rockingly moving arm 31 is suppressed, and the rockingly moving frame 26 rotatively moves by the action of the pulling force of the pulling spring 36 such that the driven roller 23 side of the transfer belt 21 comes up to the outer cover 6, and the transfer belt 21 is separated from the photosensitive drum 2. Thereby, the outer circumferential surface of the photosensitive drum 2 is prevented from getting dirty.

At a time of starting the transferring operation, the cam 21 rotates and is put on the position as shown in FIG. 2. The pressing force at the free end side of the rocking moving arm 31 exerted by the first and second levers 29 and 32 is then released by the action of the cam surface. Consequently, the driven roller 23 side of the transfer belt 21 is elastically pressed against the photosensitive drum 2 and is brought into contact therewith against the pulling force of the pulling spring 36 by action of the pressing force of a pressing spring 27.

On the other hand, in a case that transfer paper is stuffed between the photosensitive drum 2 and the transfer belt 21 due to a paper jamming, the stop lever 43 is rotated and engagement of the stop lever 43 with the stop pin 44 is released, and then the outer cover 6 is opened from the side portion of the image forming apparatus main body 1. When the outer cover 6 is opened, the transfer unit 5 together with the outer cover 6 is separated from the photosensitive drum 2. Thereby, the transporting surface of the transfer paper can be exposed in the side opening of the image forming apparatus main body 1.

At this time, since the transfer belt 21 is firstly separated from the photosensitive drum 2 by action of the pulling spring 36, there is no fear that the surface of the photosensitive drum 2 will be damaged by the transfer belt 21, etc., when the outer cover 6 is opened or closed. Furthermore, when the outer cover 6 is opened, the transfer unit 5 is also separated from the photosensitive drum 2, and thereby the transporting surface of the transfer paper is exposed in the side opening of the image forming apparatus main body 1. Consequently, the removal of the jammed paper can be performed very easily.

As is apparent from the foregoing description, according to one feature of the present invention, since guides of a transporting path for both of a transfer unit 5 and transfer paper are unitarily combined into one unit and are enabled to be opened from the image forming apparatus main body, the transfer unit 5 can be separated from the image carrier side only by opening the housing (outer cover) 6. Thereby, it turns out to be possible to recognize jammed paper by sight of an operator and to easily take out jammed paper from the apparatus main body 1. Furthermore, since the interior of the image forming apparatus can be recognized by sight, it is possible to prevent the hand(s) of the operator from being injured or made dirty.

As is apparent from the foregoing description, according to a further feature of the present invention, since one end side of a transfer belt 21 is supported so as to be attached to and detached from an image carrier 2, and a supporting fulcrum thereof is disposed downstream in the transfer paper transporting direction, the probability of an occurrence of the transfer paper becoming folded or wrinkled can be reduced. In addition, shifting of the transfer belt 21 can be prevented. Consequently, an occurrence of mechanical damage, such as a breakdown or folding of the transfer belt 21, etc., can be prevented. Furthermore, since the transfer belt 21 is not rubbed with a frame end portion, an occurrence of uncomfortable noise can also be prevented.

As is apparent from the foregoing description, according to a further feature of the present invention, since the transfer unit 5 includes a frame for supporting the transfer belt 21 so as to move in the direction of separating from an image carrier 2, a pressing section for elastically pressing the transfer belt 21 against the image carrier 27, and a force applying section for releasing the pressing section and applying a force to the frame in the direction of separating the frame from the image carrier 2, unfavorable releasing of the transfer belt from the image carrier can be prevented. Furthermore, the structural parts can be easily arranged in an interior of the machine and a margin of machine designing can be improved. Moreover, the transfer belt 21 can be prevented from making an image carrier 2 and transfer paper dirty or a strip-state dirt can be prevented from occurring on the surface of an image formed thereon.

Obviously, numerous modifications and variations of the present invention are possible in light of the above teachings. It is therefore to be understood that within the scope of the appended claims, the present invention may be practiced otherwise than as specifically described herein.

The present application is based on Japanese Priority Document 9-113920, the contents of which are incorporated herein by reference.

I claim:

1. An image forming apparatus comprising:

an image carrier; and a transfer unit including a transfer belt disposed on an outer circumferential surface of said image carrier for electrostatically attracting transfer paper thereon and transporting the transfer paper so as to guide the transfer paper, wherein said transfer unit is supported so as to move in a direction of separating from said image carrier when said transfer unit is released, and wherein a housing including a guide portion for guiding transfer paper discharged from a fixing unit is provided in a main body of said image forming apparatus so as to release therefrom.

2. The image forming apparatus as defined in claim 1, wherein said transfer belt is rockingly supported at a supporting fulcrum at one end side thereof so as to attach and detach a second end side of said transfer belt to and from said image carrier, and wherein the supporting fulcrum is provided downstream in a transfer paper transporting direction relative to said image carrier.

3. The image forming apparatus as defined in claim 1, wherein said transfer unit further comprises:

a driving roller for supporting said transfer belt;

a driven roller driven by said driving roller for further supporting said transfer belt by cooperation with said driving roller; and a frame for supporting said transfer belt so as to move in a direction of attaching to and detaching from said image carrier.

4. The image forming apparatus as defined in claim 3, wherein said transfer unit further comprises:

a pressurizing spring for elastically pressurizing said transfer belt against said image carrier; and a force applying spring for releasing said pressurizing spring and applying a force in a direction such that said frame is separated from said image carrier.

5. The image forming apparatus as defined in claim 2, wherein said transfer unit further comprises:

a driving roller for supporting said transfer belt;

a driven roller driven by said driving roller for further supporting said transfer belt by cooperation with said driving roller; and a frame for supporting said transfer belt so as to move in a direction of attaching to and detaching from said image carrier.

6. The image forming apparatus as defined in claim 5, wherein said transfer unit further comprises:

a pressurizing spring for elastically pressurizing said transfer belt against said image carrier; and a force applying spring for releasing said pressurizing spring and applying a force in a direction such that said frame is separated from said image carrier.

7. An image forming apparatus comprising:

image means on which an image is formed; and transfer means disposed on an outer circumferential surface of said image means for electrostatically attracting transfer paper thereon and transporting the transfer paper so as to guide the transfer paper to said image means, said transfer means being supported so as to move in a direction of separating from said image means when said transfer means is released, and including a guide portion for guiding transfer paper discharged from a fixing unit provided in a main body of said image forming apparatus so as to release therefrom.

8. The image forming apparatus as defined in claim 7, wherein said transfer means is rockingly supported at a supporting fulcrum at one end side thereof so as to attach and detach a second end side of said transfer means to and from said image means, and wherein the supporting fulcrum is provided downstream in a transfer paper transporting direction relative to said image means.

9. The image forming apparatus as defined in claim 7, wherein said transfer means comprises:

transfer belt means;

driving roller means for supporting said transfer belt means;

driven roller means driven by said driving roller means for further supporting said transfer belt means by cooperation with said driving roller means; and frame means for supporting said transfer belt means so as to move in a direction of attaching to and detaching from said image means.

10. The image forming apparatus as defined in claim 9, wherein said transfer means further comprises:

first spring means for elastically pressurizing said transfer belt means against said image means; and second spring means for releasing said first spring means and applying a force in a direction such that said frame means is separated from said image means.

11. The image forming apparatus as defined in claim 8, wherein said transfer means further comprises:

transfer belt means;

driving roller means for supporting said transfer belt means;

driven roller means driven by said driving roller means for further supporting said transfer belt means by cooperation with said driving roller means; and frame means for supporting said transfer belt means so as to move in a direction of attaching to and detaching from said image means.

12. The image forming apparatus as defined in claim 11, wherein said transfer means further comprises:

first spring means for elastically pressurizing said transfer belt means against said image means; and second spring means for releasing said first spring means and applying a force in a direction such that said frame means is separated from said image means.

13. An image forming method for forming an image on an image carrier, comprising the steps of:

disposing a transfer unit including a transfer belt on an outer circumferential surface of said image carrier for electrostatically attracting transfer paper thereon and transporting the transfer paper so as to guide the transfer paper;

supporting said transfer unit so as to move in a direction of separating from said image carrier when said transfer unit is released; and providing a housing including a guide portion for guiding transfer paper discharged from a fixing unit in a main body of an image forming apparatus so as to release therefrom.

14. The image forming method as defined in claim 13, wherein in said step of supporting said transfer unit, said transfer belt is rockingly supported at a supporting fulcrum at one end side thereof so as to attach and detach a second end side of said transfer belt to and from said image carrier, and such that the supporting fulcrum is provided downstream in a transfer paper transporting direction relative to said image carrier.

15. The image forming method as defined in claim 13, wherein said step of supporting said transfer unit comprises the substeps of:

supporting said transfer belt by a driving roller;

further supporting said transfer belt by a driven roller driven in cooperation with said driving roller; and supporting said transfer belt so as to move in a direction of attaching to and detaching from said image carrier.

16. The image forming apparatus as defined in claim 13, wherein said step of supporting said transfer unit comprises substeps of:

elastically pressurizing said transfer belt against said image carrier by a pressurizing spring; and releasing said pressurizing spring and applying a force in a direction such that a frame is separated from said image carrier.

17. An image forming system comprising:

a photosensitive drum on which an electrostatic latent image is formed and including an axis line supported substantially horizontally;

a charger charging a surface of said photosensitive drum;

a developing section developing the electrostatic latent image formed on said photosensitive drum to convert the electrostatic latent image into a visible toner image;

a paper feeding section for feeding transfer paper;

a pair of registration rollers transporting the transfer paper to said photosensitive drum;

a transfer unit including a transfer belt disposed on an outer circumferential surface of said photosensitive drum so as to be brought into contact with said photosensitive drum to electrostatically attract transfer paper thereon to transfer the visible toner image from said photosensitive drum to the transfer paper, and to transport the transfer paper to guide the transfer paper;

a fixing unit fixing the toner image transferred to the transfer paper;

a cleaner cleaning the photosensitive drum after transferring the toner image; and an outer cover covering a main part of the image forming system so as to open and close the image forming system, wherein when the outer cover is open the transfer unit is moved to separate from said photosensitive drum.

18. The image forming system as defined in claim 17, wherein said transfer belt is rockingly supported at a supporting fulcrum at one end side thereof so as to attach and detach a second end side of said transfer belt to and from said photosensitive drum; and wherein the supporting fulcrum is provided downstream in a transfer paper transporting direction relative to said photosensitive drum.

19. The image forming system as defined in claim 17, wherein said transfer unit further includes:

a driving roller for supporting said transfer belt;

a driven roller driven by said driving roller for further supporting said transfer belt by cooperation with said driving roller; and a frame for supporting said transfer belt so as to move in a direction of attaching to and detaching from said photosensitive drum.

20. The image forming system as defined in claim 19, wherein said transfer unit further includes:

a pressurizing spring for elastically pressurizing said transfer belt against said photosensitive drum; and a force applying spring for releasing said pressurizing spring and applying a force in a direction such that said frame is separated from said photosensitive drum.

21. The image forming system as defined in claim 17, wherein said fixing unit includes:

a fixing roller;

a pressurizing roller disposed to come into contact with an outer circumferential surface of said fixing roller; and a housing for accommodating said fixing roller and said pressurizing roller.

22. The image forming system as defined in claim 21, further comprising:

a paper inserting inlet for guiding in the transfer paper from a side of said photosensitive drum, and the paper inserting inlet being opened at a lower side of a nip portion formed between said fixing roller and said pressurizing roller.

23. The image forming system as defined in claim 22, wherein said transfer belt, driving roller, driven roller, and transfer roller are supported on a rockingly moving frame.

24. The image forming system as defined in claim 23, wherein said rockingly moving frame is rockingly supported on a supporting frame formed as a case of said transfer unit fixed on said outer cover.

25. The image forming system as defined in claim 24, wherein said rockingly moving frame is fixed at a side of said driving roller and a supporting shaft of said rockingly moving frame and a shaft of said driving roller are supported together by said supporting frame.

26. The image forming system as defined in claim 21, further comprising:

a paper discharging outlet provided at an upper side of a nip portion formed between said fixing roller and said pressurizing roller.

27. The image forming system as defined in claim 17, wherein said transfer unit further includes:

a driving roller supporting said transfer belt;

a driven roller driven by said driving roller supporting said transfer belt in cooperation with said driving roller;

a transfer roller applying a transfer bias voltage to said transfer belt; and a cleaning blade for scraping off toner from a surface of the transfer belt.

28. The image forming system as defined in claim 27, wherein said cleaning blade is supported by a supporting frame.

29. The image forming system as defined in claim 27, wherein said driven roller is rockingly supported between said photosensitive drum and said outer cover, and thereby said transfer belt is attached to and detached from said photosensitive drum at a side of said driven roller.

* * * * *